United States Patent [19]

Luton et al.

[11] Patent Number: 4,818,481

[45] Date of Patent: Apr. 4, 1989

[54] METHOD OF EXTRUDING ALUMINUM-BASE OXIDE DISPERSION STRENGTHENED

[75] Inventors: Michael J. Luton, Summit, N.J.; Raghavan Ayer, Stanford, Conn.; Ruzica Petkovic-Luton, Summit, N.J.; Joseph Vallone, Roselle, N.J.; Stephen Matras, Hillsborough Township, Somerset County, N.J.

[73] Assignee: Exxon Research and Engineering Company, Florham Park, N.J.

[21] Appl. No.: 23,851

[22] Filed: Mar. 9, 1987

[51] Int. Cl.[4] ..... B22F 1/00

[52] U.S. Cl. ..... 419/67; 75/244; 419/13; 419/41

[58] Field of Search ..... 419/67, 41, 13; 75/244

[56] References Cited

U.S. PATENT DOCUMENTS

| | | | |
|---|---|---|---|
| 3,874,938 | 4/1975 | Benjamin et al. | 419/30 |
| 4,297,136 | 10/1987 | Pickens et al. | 419/11 |
| 4,532,106 | 7/1985 | Pickens | 419/19 |
| 4,619,699 | 10/1986 | Luton | 75/254 |
| 4,624,705 | 11/1986 | Jatkar et al. | 419/33 |
| 4,647,304 | 3/1987 | Luton | 419/33 |

*Primary Examiner*—Stephen J. Lechert, Jr.
*Attorney, Agent, or Firm*—Henry E. Naylor

[57] ABSTRACT

Disclosed is a method for extruding fine grain aluminum mechanically alloyed powder material such that the resulting extruded product is substantially free of texture, which method comprises extruding a billet of the powder material having a mean grain size less than about 5 microns through a die having an internal contour which conforms substantially to the formula:

$$\frac{1}{R^2} = \frac{1}{R_o^2} + Kx$$

where R is the radius of the die contour at any given point x along the major axis of the die orifice from its entry plane, $R_o$ is the radius of the billet, and K is an arbitrary constant.

12 Claims, 12 Drawing Sheets

METHOD OF EXTRUDING ALUMINUM-BASE OXIDE DISPERSION STRENGTHENED

FIELD OF THE INVENTION

The present invention relates to aluminum-base oxide dispersion strengthened extruded products substantially free of texture.

BACKGROUND OF THE INVENTION

There is a great need for metal alloys having high strength and good ductility which can withstand adverse environments, such as corrosion and carburization, at increasingly higher temperatures and pressures. The upper operating temperature of conventional heat resistant alloys is limited to the temperature at which second phase particles are substantially dissolved in the matrix or become severely coarsened. Above this limiting temperature, the alloys no longer exhibit useful strength. One class of alloys which is exceptionally promising for such uses are dispersion strengthened alloys obtained by mechanical alloying techniques. These dispersion strengthened alloys, especially the oxide dispersion strengthened alloys, are a class of materials containing a substantially homogeneous dispersion of fine inert particles, which alloys can exhibit useful strength up to temperatures approaching the melting point of the alloy material.

The primary requirement of any technique used to produce dispersion strengthened metallic materials is to create a homogeneous dispersion of a second (or hard) phase which has the following characteristics:

- small particle size (<50 nm), preferably oxide particles;
- low interparticle spacing (<200nm);
- chemically stable second phase, (The negative free energy of formation should be as large as possible and should not exhibit any phase transformation within the operation range of the alloy);
- substantially insoluble in the metallic matrix.

Dispersion strengthened alloys are generally produced by conventional mechanical alloying methods wherein a mixture of metal powder and second, or hard, phase particles, are intensively dry milled in a high energy mill, such as the Szeguari attritor. Such a process is taught in U.S. Patent No. 3,591,362 for producing oxide dispersion strengthened alloys, which patent is incorporated herein by reference. The high energy milling causes repeated welding and fracturing of the metallic phase, which is accompanied by refinement and dispersion of the hard phase particles. The resulting composite powder particles are generally comprised of a substantially homogeneous mixture of the metallic components and an adequate dispersion of the second, or hard, phase. The bulk material is then obtained by hot or cold compaction and extrusion to final shape.

One reason for the lack of general adoption of commercial dispersion strengthened alloys, for example oxide dispersion strengthened alloys, by industry has been the lack of technically and economically suitable techniques for obtaining a uniform dispersion of fine oxide particles in complex metal matrices that are free of microstructural defects and that can be shaped into desirable forms, such as tubulars. Although research and development on oxide dispersion strengthened materials have continued over the last two decades, the materials have failed to reach their full commercial potential. This is because prior to the present invention, development of microstructure during processing, which would permit the control of grain size and grain shape in the alloy product, was not understood. Furthermore, there was no explanation of the formation of intrinsic microstructural defects introduced during processing, such as oxide stringers, boundary cavities, and porosity.

Oxide stringers consist of elongated patches of oxides of the constituent metallic elements. These stringers act as planes of weakness across their length as well as inhibiting the control of grain size and grain shape during subsequent recrystallization. Porosity, which includes grain boundary cavities, is detrimental to dispersion strengthened alloys because it adversely affects yield strength, tensile strength, ductility, and creep rupture strength.

There is a great need in various industries for lightweight, high-strength metallurgical materials. Such materials would be particularly useful for the manufacture of aircraft skins, aircraft interior structures, rifle parts, automotive parts, and drilling pipe for oil well exploration. The leading candidate for such materials are aluminum-base materials. Aluminum and aluminum-base alloys are commonly selected to serve in applications where high strength to weight ratio is the primary consideration. Such metals, however, can generally be used only at relatively low temperatures because of the tendency of conventional aluminum-base alloys to lose strength at temperatures above half their absolute melting temperature (i.e.>200° C.). The demand for increased fuel efficiency and higher load factors in the aerospace industry has prompted the demand for aluminum alloys as skin and frame materials to replace titanium alloys and high strength steels. More recently, the requirements of torque and drag reduction in directional drilling has promoted the use of aluminum-base alloys as drill strings, but their use is severely limited by the aforementioned problem of loss of strength at elevated temperatures.

Early attempts to increase the strength of aluminum included hot pressing aluminum powder in an oxygen containing atmosphere such that thin layers of aluminum oxide form, in situ, on the surface of the original aluminum powder particles. This dispersion strengthened aluminum material, commonly known as sintered aluminum product (S.A.P.), exhibited surprisingly high levels of hardness and tensile strength. The drawback with this approach is that the aluminum oxide, although insoluble, was relatively coarsely dispersed. As a result, the alloys did not achieve very high strength at elevated temperatures and thus, were not reduced to industrial practice.

In order to produce aluminum dispersion strengthened materials without the disadvantages of the sintered powder materials, mechanical alloying methods were used. Such techniques generally produce a more homogeneous material and offer more accurate and precise control over chemical composition. Furthermore, these mechanical techniques are suitable for the preparation of multi-component materials where one or more of the components are immiscible in each other. For example, tungsten and copper, or a refractory material in a metal.

Early attempts to produce dispersion strengthened aluminum material by these mechanical techniques were unsuccessful. This is because the malleability of aluminum causes the powdered particles to weld to each other as well as to weld to the components of the process equipment, thus inhibiting the dispersion of the dispersed phase. One attempt to alleviate this problem is disclosed in U.S. Patent No. 4,409,038 to Novamet Inc. which discloses the use of a process control agent, such as stearic acid, to prevent such welding. While this procedure has met with a limited degree of success, it is unable to produce a dispersion strengthened material where the dispersoid is a refractory which is insoluble in the matrix. For example, the above procedure results in an alloy strengthened with coarsely dispersed oxides and finely dispersed carbides. These coarsely dispersed oxides afford little strength because of their relatively wide spacing and the carbides are relatively unstable and tend to coarsen at elevated temperatures, leading to rapid loss of strength. Thus, such alloys are usually restricted to use at temperatures below about 200° C.

Consequently, there still exists a need in the art for dispersion strengthened aluminum materials having high temperature strength.

SUMMARY OF THE INVENTION

In accordance with the present invention, there is provided extruded mechanically alloyed aluminum products which are substantially free of texture.

In preferred embodiments of the present invention the extruded product is comprised of an aluminum matrix with oxy-nitride particles substantially uniformly dispersed therein.

In still other preferred embodiments of the present invention the extruded product is comprised of at least 50 wt. % aluminum, oxy-nitrides, and one or more other metals, refractory materials, or both.

The texture free aluminum materials of this invention are prepared by extruding a billet of mechanically alloyed aluminum powder material containing powder particles comprised of grains having a mean grain size less than about 5 microns through an extrusion die having an internal contour which conforms substantially to the formula:

$$\frac{1}{R^2} = \frac{1}{R_0^2} + Kx$$

where

R is the radius of the die contour at any given point x along the major axis of the die orifice from ts entry plane;

$R_o$ is the radius of the billet, and K is an arbitrary constant.

FIG. **9*a*** is a bright field transmission electron micrograph of the aluminum base material of the present invention produced in accordance with Example 1 hereof and consolidated by extrusion.

FIG. **9*b*** is a bright field transmission electron micrograph of the aluminum base material of the present invention produced in accordance with Example 1 hereof, and consolidated by extrusion. The arrows indicate the oxy-nitrides which are typically about 3 nm in diameter.

Figure 10:
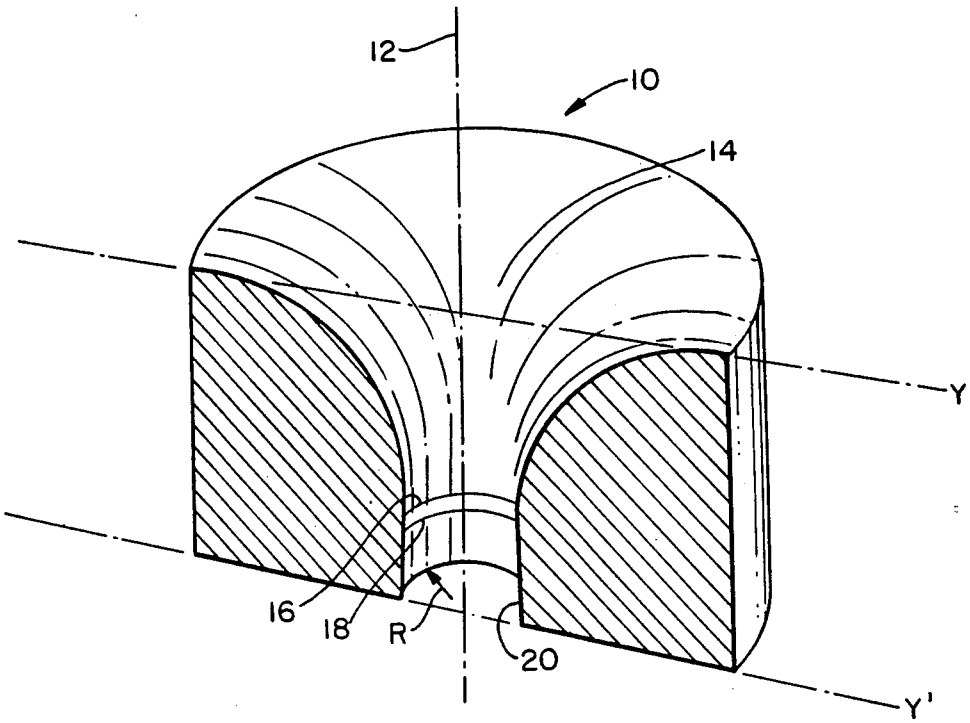

FIG. 10 is a perspective sectional view of a die used to extrude rods in accordance with the present invention.

Figure 11:
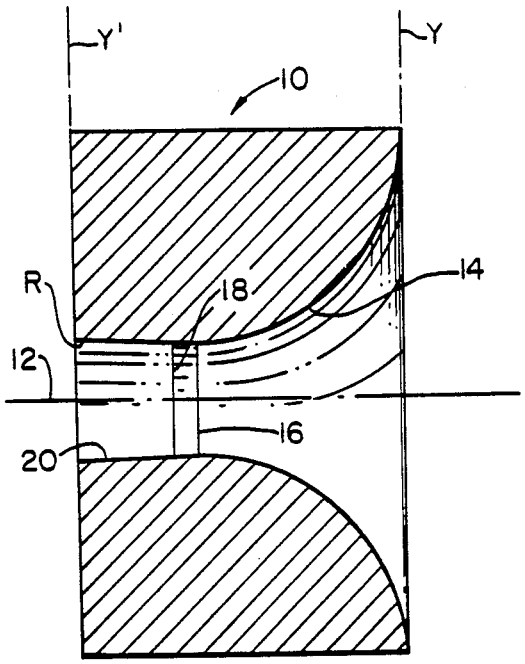

FIG. 11 is a cross-sectional view of a die used in the present invention for extruding rods wherein the internal contour of the die is illustrated.

Figure 12:
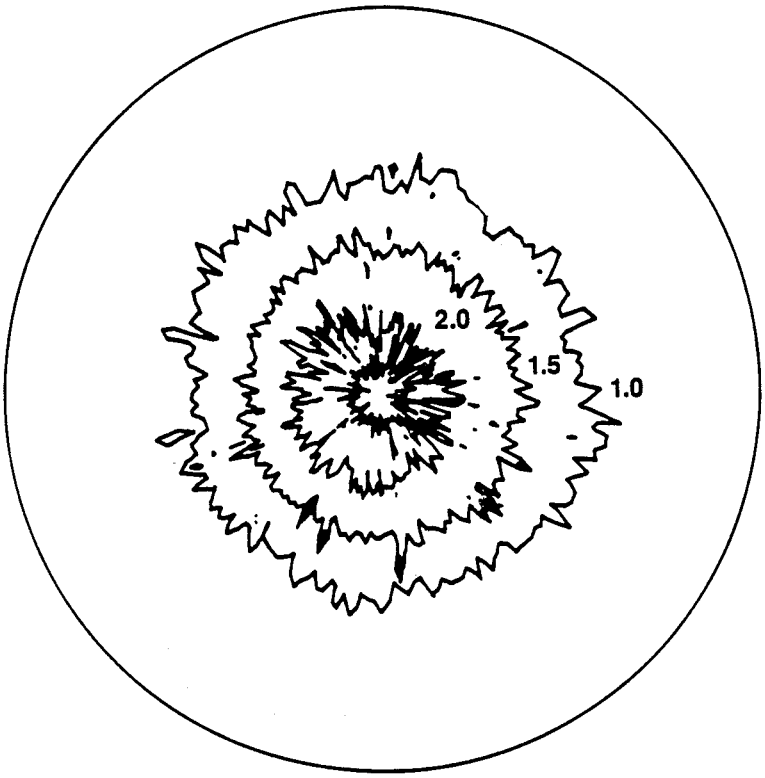

FIG. 12 is a standard <200>pole figure of the aluminum—aluminum oxy-nitride material with 3% alumina which is set forth in Table IX hereof and was obtained from a section cut perpendicular to the extrusion axis.

DETAILED DESCRIPTION OF THE INVENTION

By the practice of this invention, aluminum base dispersion strengthened materials, are produced having:

- aluminum oxy-nitride particles which are substantially uniformly distributed throughout the matrix at distances from each other on the average of less than about 20 nm, thereby resulting in a material having superior high temperature strength;
- sufficient stored energy during the process of cryomilling that on subsequent reheating of the alloyed powder, energy is released which results in fine grain sizes within the resulting composite powder particles; and
- composite powder surfaces which are substantially free of oxide scale.

The strength ($\sigma$) of a composite material is related to the elastic modulus of the matrix (E) and the interparticle space of the dispersoid particles in accordance with the following expression:

$$\sigma = \alpha \frac{E}{\lambda}$$

where $\alpha$ is a numerical constant.

When iron base dispersion strengthened materials are produced by cryogenic milling, the interparticle distance of the dispersoid is of the order of about 60 nm. Since the elastic modulus of iron is 210 GPa, this interparticle distance is adequate to provide the required strength in such materials. As per the above expression, the interparticle spacing of the dispersoid in the iron base system can be achieved by the refinement of the refractory powders during cryomilling alone. For a metal such as aluminum, the elastic modulus is approximately $\frac{1}{3}$ that of iron and, therefore, the interparticle spacing has to be three times smaller (<20 nm) to achieve equivalent high temperature strength. Since the required interparticle distance can be only achieved by having the dispersoid in the size range of about 2–6 nm, it cannot be obtained by the refinement of refractory phase alone, as in the case of iron. The fine scale dispersoids, in an aluminum system, are instead realized through a controlled chemical reaction at an atomic scale. By the use of the cryomilling process, in a nitrogen containing cryogenic liquid having up to 1 wt. % oxygen, an in situ surface reaction of the reactive aluminum and nitrogen can be carried out at a temperature of about 77° K. At this temperature, the thermodynamics and kinetics are favorable for the formation of extremely fine oxy-nitride species through the reaction of aluminum, oxygen, and nitrogen.

Because mechanical milling of one or more metals is a process in which initial constituent powders are repeatedly fractured and cold welded by the continuous impacting action of milling elements, considerable strain energy is stored during this operation. During subsequent reheating prior to extrusion, recrystallization of the resulting composite powder occurs. It is well-known that the grain size produced by recrystallization after cold working depends on the degree of cold working. However, there is a lower limit of work below which recrystallization does not occur. Inasmuch as the degree of cold work is a measure of the strain energy stored in the material, we have found that a decrease in the milling temperature leads to an increase in the amount of work that can be stored in the material over a given period of time and the amount of work that can be stored to saturation. Accordingly, a decrease in milling temperature leads to an increase in the rate of reduction of the powder particle size as well as a decrease in the grain size achieved at long milling times.

The production of ultra-fine grains during the recrystallization prior to extrusion serves to alleviate the tendency of the material to form grain boundary cavities during extrusion and subsequent working. We believe the reason for this is that as the grain size is refined, more and more of the sliding deformation can be accommodated by diffusional processes in the vicinity of the grain boundaries. As a result, the concentration of slip within the grains is reduced and grain boundary concentration of slip bands is proportionally reduced.

As previously discussed, oxide stringers are elongated patches of oxides of constituent metallic elements, such as aluminum, chromium, and iron. We have surprisingly discovered that these oxide stringers initiate from oxide scale formed on the particles during ball milling in air. Even more surprisingly, this oxide scale forms during conventional milling with industrial grade argon, when such metals as aluminum, chromium, and iron react with trace amounts of oxygen to form external oxide scale on the surface of the particles of the metal powders during milling. These scales break during subsequent consolidation and elongate during extrusion to form oxide stringers. The stringers act as centers of weakness in the bulk material as well as serving to inhibit grain boundary migration during annealing. By doing so, they interfere with control of grain size and grain shape during the final thermomechanical treatment steps. Although oxygen is employed in the practice of the present invention, the temperatures at which the cryomilling is performed are sufficiently low to prevent the formation of such oxide scale.

The properties of the materials produced by the practice of the present invention include:

substantially homogeneous fine dispersion of the refractory (typically particles with a mean diameter of about 3 nm with a spacing of about 20 nm), freedom from external oxide scale and, a far greater ability to form extruded products substantially free of texture under commercially feasible conditions.

Refractory compounds suitable for use in the practice of the present invention include oxy-nitrides, oxides, carbides, nitrides, borides, carbo-nitrides, and the like whose negative free energy of formation of the oxide per gram atom of oxygen at about 25° C. is at least about 90,000 calories and whose melting point is at least about 1300° C. Preferred are oxy-nitrides and oxides. Such oxy-nitrides and oxides include those of silicon, aluminum, yttrium, cerium, uranium, magnesium, calcium, beryllium, thorium, zirconium, hafnium, titanium, and the like. Also included are the following mixed oxides of aluminum and yttrium: $Al_2O_3.2Y_2O_3$ (YAP), $Al_2O_3.Y_2O_3$ (YAM), and $5Al_2O_3.3Y_2O_3$ (YAG). Preferred are oxy-nitrides and oxides of aluminum, more preferred is aluminum oxy-nitride.

The total amount of aluminum oxy-nitrides present in the materials of the present invention will be at least an effective amount. By effective amount we mean that minimum amount required to increase the strength of the aluminum matrix by at least about 10%, more preferably at least about 20%. Generally this amount will be up to about 5 vol. %, preferably up to about 2 vol. %, more preferably up to about 1 vol. %, and most preferably from about 0.1 to 0.5 vol. %, based on the total volume of material. When one or more other refractory compounds are present, the total volume of refractory material, that added plus that produced insitu, will be from about 0.5 to 25%, preferably from about 0.5 to 10%, and more preferably 0.5 to 5%, based on the total volume of the material.

Prior to the present invention, it was not practical to mechanically alloy a malleable metal such as aluminum. This was because aluminum has a tendency to stick to the attritor and attritor elements. Even when process control agents are used during conventional milling to substantially eliminate this problem, the result is a material having insufficient high temperature strength for many industrial uses. By the practice of the present invention, aluminum and alloys based on aluminum, may now be successfully mechanically alloyed, by cryogenic milling, to produce dispersion strengthened composite particles having a substantially homogeneous dispersion of aluminum oxy-nitride particles throughout the matrix.

The dispersion-strengthened mechanically alloyed aluminum of the present invention is composed principally of aluminum and dispersoid. It may also contain various additives which may, for example, solid solution harden, or age harden, the aluminum and provide certain specific properties. Magnesium, for example, which forms solid solutions with aluminum, will provide additional strength with corrosion resistance, good fatigue resistance and low density. Other additives for additional strength include, for example, Li, Cr, Si, Zn, Ni, Ti, Zr, Co, Cu, and Mn. Additives to aluminum and the amounts added are well known in the art.

In general, the dispersion-strengthened mechanically alloyed aluminum material of the present invention is comprised of, by weight, at least about 50%, preferably at least about 80%, and more preferably at least about 90% aluminum, based on total weight of the material.

The present invention is practiced by charging a nitrogen-containing cryogenic material, such as liquid nitrogen, into a high energy mill containing an aluminum powder. Other metallic powders and/or refractory materials may also be present. The high energy mill also contains attritive elements, such as metallic or ceramic balls, which are maintained kinetically in a highly activated state of relative motion. The milling operation, which is conducted in the presence of an effective amount of oxygen, is continued for a time sufficient to:

cause the constituents of the mixture to comminute and bond, or weld, together and to co-disseminate throughout the resulting metal matrix of the product powder;

obtain the desired particle size and fine grain structure upon subsequent recrystallization by heating.

By effective amount of oxygen, we mean that amount which will lead to the desired amount of aluminum oxy-nitride up to that amount which would cause the formation of oxide scale on the surface of the metallic powder particles. This amount will generally be up to about 1 wt. %, preferably from about 0.01 to 0.5 wt. %. The material resulting from this milling operation can be characterized metallographically by a cohesive internal structure in which the constituents are intimately united to provide an interdispersion of comminuted fragments of the starting constituents.

During the milling process herein, the initial aluminum powder particles collide with the attritive elements and fracture. This fracturing produce atomically clean surfaces with highly reactive aluminum atoms. The nitrogen and oxygen atoms present absorb onto these clean surfaces and bond with the aluminum atoms thereby forming complexes of aluminum, oxygen, and nitrogen which is referred to herein as aluminum oxy-nitrides. The size of these complexes are ultrafine. That is, they are generally in the range of about 300–700 atoms (2 to 5 nm in diameter). In addition to these insitu-produced aluminum oxy-nitrides, the metallic matrix can contain other refractory compounds introduced with the initial powder charge. After cryogenic milling, these refractory compounds will be in the size range of 30–50 nm. Thus, only by producing the aluminum oxy-nitride insitu can one obtain the ultrafine particle sizes which lead to the superior properties of the composite powders of the present invention.

The term cryogenic medium, as used herein, means a nitrogen-containing liquid material such that it is capable of producing aluminum oxy-nitrides having an average diameter from 1 to 10 nm. Preferred is liquid nitrogen.

The materials of the present invention are extruded such that the extruded product is substantially free of texture. The term substantially free of texture as used herein means the extruded material is substantially free of preferred crystallographic orientation. Another way of expressing this is that when a pole figure is obtained from the material which is substantially free of texture, no region of the pole figure would show a pole density greater than about 10 times that which would be obtained from a randomly oriented sample, more preferably no more than about 5 times, and most preferably no more than about 3 times. This renders the material isotropic, that is, having substantially the same mechanical and physical properties in all directions. It is possible to obtain such material by the practice of the present invention because the internal contour of the die is such that it changes continuously in the die zone in such a manner as to cause the material being extruded through the die to conform substantially to the formula:

$$A = \frac{A_o}{\left[1 + \frac{\dot{\epsilon}}{v} x\right]}$$

where

A is the area of cross-section at any given point x along the major axis of the die orifice from the entry plane of the die;

$A_o$ is the area cross-section of the billet;

$\dot{\epsilon}$ is the true (or natural) strain rate; and v is the velocity of the ram of the extrustion press.

The mechanically alloyed powder materials of the present invention are formed into billets by any appropriate conventional means. The billet is then hot-worked by such techniques as forging, upsetting, rolling, or hot isostatic pressing to consolidate the powder prior to extrusion.

FIG. 10 hereof shows a perspective sectional view of a die for extruding rods of the present invention at 10 and FIG. 11 shows a cross-sectional view of the same die. The contour of the internal passageway 14 substantially conforms to the formula $$\frac{1}{R^2} = \frac{1}{R_o^2} + Kx$$

(i) For a given desired extrusion ratio, E, where E is equal to the ratio of the area of cross section of the billet to the area of cross-section of the extruded rod, the length L, of the converging die channel is given by:

$$L = \frac{(E-1)}{KR_o^2}$$

(ii) For a given ram velocity, v, the true strain rate imposed on the material, passing through the die is given by:

$$\dot{\epsilon} = K\, v\, R_o$$

whose variables have been previously identified herein. The radius R of the die orifice, or passageway, is indicated at any given point x along the major axis 12 of the die orifice from entry plane Y. The die includes an entry orifice at entry plane Y where the radius of the die orifice is at a maximum. The die profile 14, sometimes also referred to herein as the internal contour of the die, converges in accordance with the above formula and terminates at some distance along the major axis as indicated at 16. The die orifice may then contain a small parallel section between 16 and 18 which section, if present, should be kept to a minimum length to minimize the friction of the extruding material along the internal walls of the die orifice. From 18 to the exit plane Y', the radius of the internal contour of the die increases slightly 20 to allow for breakaway of the extruded product from the die. This breakaway section of the die is conventional and its upper limit is usually set by the die support system. Although the actual degree of breakaway is conventional and can be easily calculated by one have ordinary skill in the art for any given die system, it will usually have a lower limit of about 3 degrees.

In general, the present invention is practiced by placing a heated billet comprised of the fine grain aluminum based powder in a can into the container of an extrusion press. The billet may be prepared by first loading a billet-can with fine grain powder material. The billet-can may be comprised of any suitable aluminum base material. The billet is coated with conventional lubricant, such as graphite or molybdenum desulfide, which is also applied to the container wall and the die. It may be preferred that the billet have an elongated section at its front end so that it fits snugly into the die orifice to prevent loss of lubricant prior to extrusion. The billet is then extruded by causing the ram to move in the forward direction at a predetermined velocity which causes the billet to extrude at a constant natural strain rate into a rod through the die 10 whose exit plane rests up against shear plate of the extrusion press. The particular temperature and strain-rate required for any given material to be extruded with enhanced plasticity so as to produce a product substantially free of texture, can be determined by first measuring the strain rate sensitivity of the material by such conventional techniques as tensile tests, compression tests, or torsion tests. A combination of temperature and strain-rate is then calculated which would give a strain rate sensitivity in excess of about 0.4. The procedure used herein for determining criteria for any given dispersion strengthened material will be discussed in detail in a following section hereof.

The die used to extrude the fine grain composite material into tubes must have an internal contour which substantially conforms to the formula $$\frac{1}{R^2} = \frac{(1 + Bx)}{(R_o^2 + R_m^2 Kx)}$$

where

R is the radius of the die contour at any given point X along the major axis of the die orifice from its entry plane;

$R_o$ is the outer radius of the billet;

$R_m$ is the radius of the mandrel; and

B is an arbitrary constant $$\dot{\epsilon} = Kv$$

whose variables have been previously defined.

The following examples serve to more fully describe the present invention. It is understood that these examples in no way serve to limit the true scope of this invention, but rather, are presented for illustrative purposes.

Comparative Example A 585 g of metal powder mixture comprised of 567.5 g of aluminum and 17.5 g of alumina was charged into a high speed attritor (ball mill) manufactured by Union Process Inc., Laboratory model I-S. The attritor contained 6 mm diameter stainless steel balls at an initial ratio, by volume, of 18:1.

Milling was carried out in argon at room temperature (about 25° C.), with a mill rotation speed of 180 rpm.

The test run was terminated after 28 minutes as the mill stalled. Inspection of the mill, showed that the alloy powder had welded together and partially to the mill forming a "horseshoe" shaped patch around the perimeter of the mill. This result indicates that dry milling without the aide of a release agent is not possible with aluminum base systems, because of the extreme maleability of the metallic phase and the propensity for freshly created aluminum surface to cold-weld together.

Comparative Example B

Samples Novamet IN 9052-F, Novamet IN 9021-F T-651 and Novamet IN 905XL were purchased from Novamet Inc. These alloys, to the best of our knowledge, were prepared by the practice of the mechanical alloying technology taught in U.S. Pat. No. 4,297,136, which calls for the preparation of mechanically alloyed powders by ball milling component metal powders in the presence of argon and a milling aide (process control agent) at room temperature.

Figure 1:
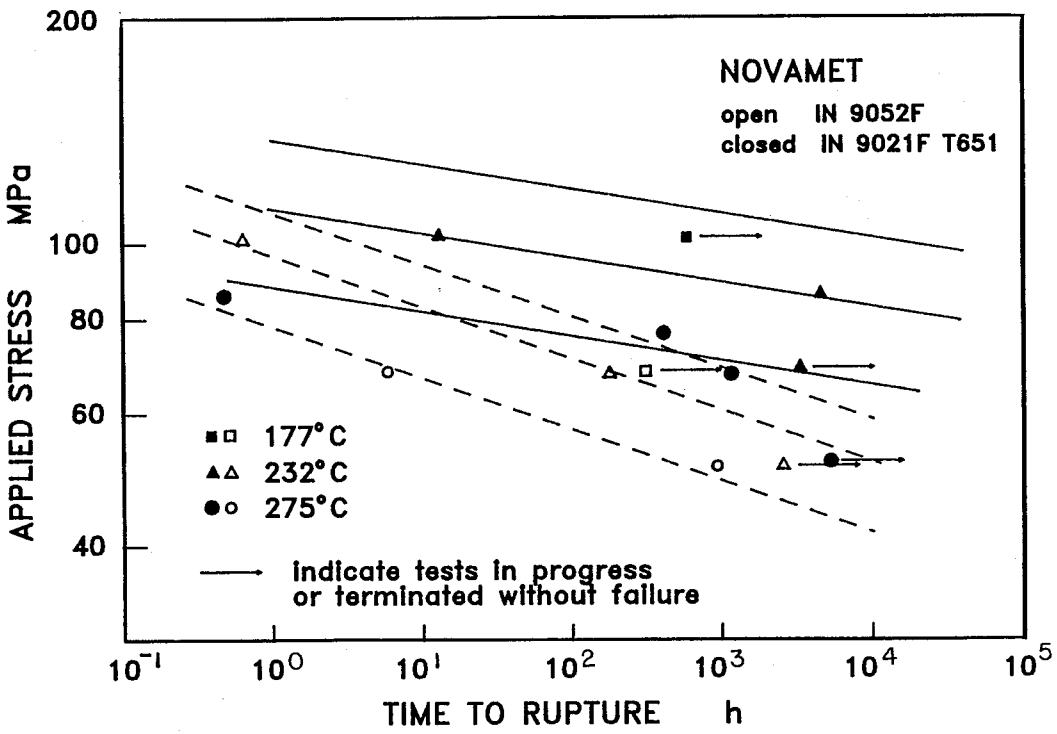
FIG. 1 is a graphical representation of the creep rupture data obtained for the mechanically alloyed aluminum alloys manufactured by Novamet; namely IN 9052-F (open symbols) and IN 9021-F T-651 (closed symbols).
Figure 2:
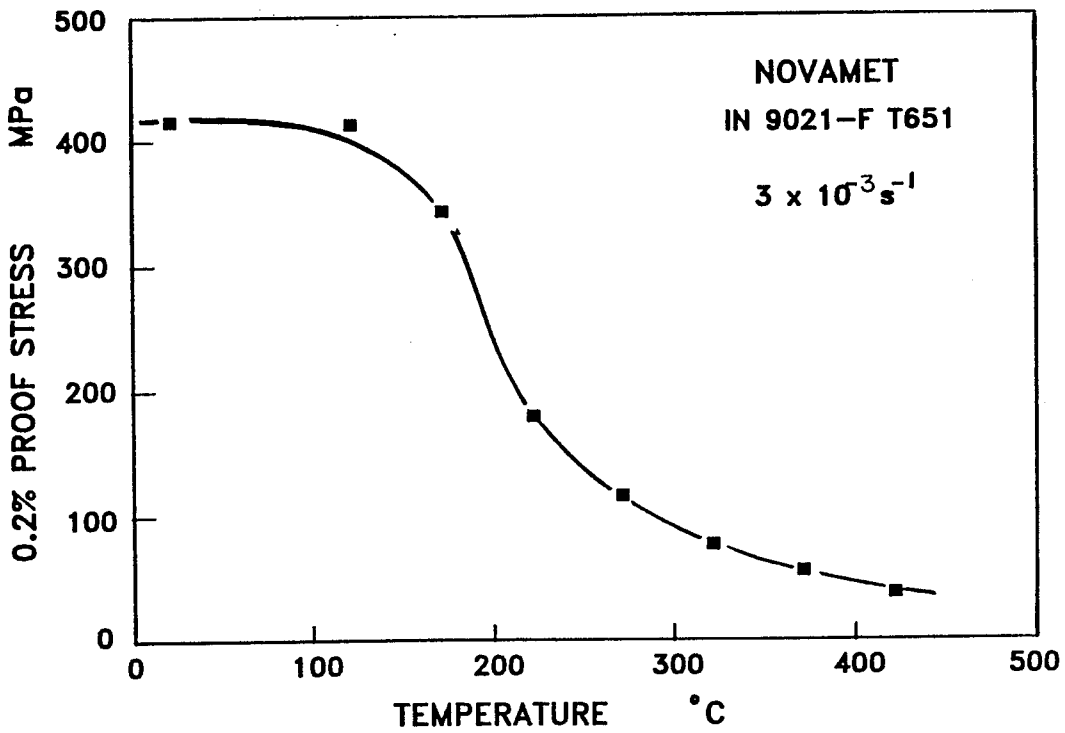
FIG. 2 is a plot of the 0.2% proof stress versus temperature, obtained in compression for the Novamet alloy IN 9021-F T-651.

Test samples, measuring 7.2×5.6 mm in diameter, were prepared as compression test samples from the alloy IN 9021-F T-651 and others, measuring 25×8.1 mm diameter, were prepared as creep specimens from both the IN 9021-F T-651 and the IN 9052-F. The creep samples were subjected to constant stress creep testing at temperatures of 177°, 232°, and 275° C. and at applied stress levels between 51 and 103 MPa. The time to rupture versus the applied stress and temperature, obtained from these tests are tabulated in Tables I and II, and plotted as stress-rupture curves in FIG. 1. The compression samples were subjected to uniaxial compression at a strain rate of $3\times10^{-3}\ s^{-1}$. The force and sample contraction were measured and the stress-strain response of the material derived. Compression test were performed at 25°, 125°, 175°, 225°, 275°, 325°, 375° and 425° C. The 0.2% offset proof stress was determined for each of the test samples and these data are tabulated in Table III and plotted against the test temperature in FIG. 2.

TABLE I

CREEP RUPTURE DATA FOR NOVAMET IN 9052-F

| Temperature °C. | Applied Stress MPa | Time to Rupture h |
|---|---|---|
| 177 | 68.9 | 332+ |
| 232 | 51.8 | 2592+ |
| 232 | 68.9 | 242 |
| 232 | 103.4 | 0.7 |
| 275 | 51.8 | 1004 |
| 275 | 68.9 | 6.4 |

TABLE II

CREEP RUPTURE DATA FOR NOVAMET IN 9021-F T-651

| Temperature °C. | Applied Stress MPa | Time to Rupture h |
|---|---|---|
| 177 | 103.4 | 600+ |
| 232 | 68.9 | 3264+ |
| 232 | 86.1 | 4642 |
| 232 | 102.4 | 13.2 |
| 275 | 51.8 | 5230+ |
| 275 | 68.9 | 1121 |
| 275 | 75.8 | 377.8 |

TABLE II-continued

| CREEP RUPTURE DATA FOR NOVAMET IN 9021-F T-651 | | |
|---|---|---|
| Temperature °C. | Applied Stress MPa | Time to Rupture h |
| 275 | 86.1 | 0.5 |

TABLE III

| COMPRESSION TEST DATA FOR NOVAMET 9021-F T651 | | |
|---|---|---|
| Temperature °C. | Strain Rate/ s | Yield Stress MPa |
| 25 | $3 \times 10^{-3}$ | 412 |
| 125 | $3 \times 10^{-3}$ | 410 |
| 175 | $3 \times 10^{-3}$ | 340 |
| 225 | $3 \times 10^{-3}$ | 176 |
| 275 | $3 \times 10^{-3}$ | 113 |
| 325 | $3 \times 10^{-3}$ | 72 |
| 375 | $3 \times 10^{-3}$ | 52 |
| 425 | $3 \times 10^{-3}$ | 34 |

In addition, the as received bars were sectioned, mounted and polished in preparation for optical microscopy. Also, thin sections were taken from the bar of the alloy IN 905XL and used to prepare thin foil samples for transmission electron microscopy. Examples of the transmission electron micrographs obtained from this material are shown in FIG. 3.

Results

Figure 3:
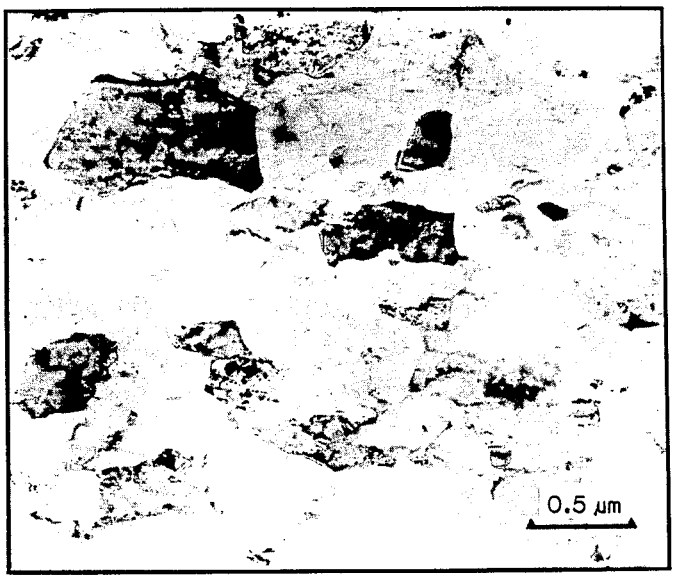
FIG. 3 is a bright field transmission electron micrograph of the Novamet alloy IN 905XL, described in Comparative Example B hereof.

Electron microscopy of the samples of Novamet IN905XL shows that the average grain size ranged from 0.5 to more than 2 μm, see FIG. 3. The relatively large grain size distribution is a result of the absence of a uniform distribution of ultra-fine dispersoids. Similar observations were made on the microstructures of the other two Novamet alloys investigated.

The data obtained from the uniaxial compression tests (see FIG. 2) show that, although the alloys exhibit high strength near room temperature, i.e. up to 175° C., the strength drops-off rapidly with further increase in temperature.

Example 1

Five 585 g batches of metal/oxide powder mixtures were prepared by the procedures described in Comparative Example A (above) except that the milling was carried out in a liquid nitrogen slurry and the attritor was modified to permit a continuous flow of liquid nitrogen so as to maintain a liquid. The four batches of metal/oxide powder mixtures were prepared with 3%, 7%, 10% and 15% by weight of alumina; that is 17.5 g, 40 g, 58.5 g and 87.8 g of alumina, respectively.

In each case, milling was carried out for a period of 15 h. On completion of the milling, the powders were allowed to heat to room temperature under a continuous flow of dry argon and then removed from the mill. The powders were screened to remove particles greater than 250 μm and then charged into aluminum cans (cylindrical tubular vessels with end-caps and evacuation ports). The cans were evacuated and heated under vacuum to 250° C. over a period of 24 h. The cans were then sealed and charged into an ASEA Model SL-1 Mini-Hipper Laboratory Hot Isostatic Press. The canned powders were subjected to a temperature of 510° C. for 5 h under confining pressure of 2000 bar ( ≈206.7 MPa). Samples of the consolidated powders, produced in this way, were prepared for metallography and mechanical testing.

Samples of each of the cryo-milled powders were mounted in a transparent mounting medium, polished, and examined optically for particle size and particle shape. The samples were also examined by scanning electron microscopy. The particle size and aspect ratio are given in Table IV for the four alloys.

TABLE IV

| PARTICLE SIZE AND SHAPE FOR CRYOMILLED POWDERS | | | |
|---|---|---|---|
| Alumina Content % | Particle Size μm | Standard Deviation | Aspect Ratio |
| 3 | 14.6 | 12.7 | .612 |
| 7 | 15.5 | 13.0 | .591 |
| 10 | 19.6 | 15.9 | .565 |
| 15 | 17.9 | 14.9 | .617 |

Samples of the consolidated powders containing 3%, 7% and 15% alumina were sectioned, mounted in bakelite, polished, and examined by optical and scanning electron microscopy.

Samples of the powders consolidated by hot isostatic pressing(HIP) and containing 3%, 7% and 15% alumina were cut into cylinders measuring 6 mm in diameter and 9 mm in length. These samples were subjected to uniaxial compression at a strain rate of $3 \times 10^{31\ 3}\ s^{-1}$. The force and sample contraction were measured and the stress-strain response of the material derived. Compression test were performed at 25°, 125°, 175°, 225°, 275°, 325°, 375° and 425° C. The 0.2% offset proof stress was determined for each of the test samples and these data are tabulated in Tables V, VI and VII and plotted against the test temperature in FIGS. 4 to 6. In addition, samples of the hot isostatically pressed powders of the aluminum 3% alumina alloy were swaged to a 70% reduction and cut in samples, measuring 25×8.1 mm in diameter as creep specimens. These latter samples were subjected to constant stress creep at temperatures between 232° and 275° C. and at stress levels between 34 and 103 MPa. These data are Tabulated in Table VIII and represented graphically in FIG. 7.

TABLE V

| COMPRESSION TEST DATA FOR ALUMINUM/OXYNITRIDE-3% ALUMINA AS HIPPED | | |
|---|---|---|
| Temperature °C. | Strain Rate/ s | Yield Stress MPa |
| 25 | $3 \times 10^{-3}$ | 450 |
| 125 | $3 \times 10^{-3}$ | 443 |
| 175 | $3 \times 10^{-3}$ | 373 |
| 225 | $3 \times 10^{-3}$ | 223 |
| 275 | $3 \times 10^{-3}$ | 206 |
| 325 | $3 \times 10^{-3}$ | 163 |
| 375 | $3 \times 10^{-3}$ | 110 |
| 425 | $3 \times 10^{-3}$ | 105 |

TABLE VI

| COMPRESSION TEST DATA FOR ALUMINUM/OXYNITRIDE-7% ALUMINA AS HIPPED | | |
|---|---|---|
| Temperature °C. | Strain Rate/ s | Yield Stress MPa |
| 25 | $3 \times 10^{-3}$ | 511 |
| 125 | $3 \times 10^{-3}$ | 493 |
| 175 | $3 \times 10^{-3}$ | 443 |
| 225 | $3 \times 10^{-3}$ | 283 |
| 275 | $3 \times 10^{-3}$ | 196 |
| 325 | $3 \times 10^{-3}$ | 146 |
| 375 | $3 \times 10^{-3}$ | 104 |
| 425 | $3 \times 10^{-3}$ | 105 |

TABLE VII

COMPRESSION TEST DATA FOR ALUMINUM/OXYNITRIDE-15% ALUMINA AS HIPPED

| Temperature °C. | Strain Rate/ s | Yield Stress MPa |
|---|---|---|
| 25 | $3 \times 10^{-3}$ | 504 |
| 125 | $3 \times 10^{-3}$ | 495 |
| 175 | $3 \times 10^{-3}$ | 451 |
| 225 | $3 \times 10^{-3}$ | 323 |
| 275 | $3 \times 10^{-3}$ | 206 |
| 325 | $3 \times 10^{-3}$ | 163 |
| 375 | $3 \times 10^{-3}$ | 99 |
| 425 | $3 \times 10^{-3}$ | 105 |

TABLE VIII

CREEP RUPTURE DATA FOR ALUMINUM/OXYNITRIDE-3% ALUMINA AS HIPPED

| Temperature °C. | Applied Stress MPa | Time to Rupture h |
|---|---|---|
| 232 | 34.5 | 10,986* |
| 232 | 68.9 | 5,491+ |
| 232 | 103.4 | 215+ |
| 275 | 51.8 | 10,773* |
| 275 | 68.9 | 452+ |
| 275 | 103.4 | 310+ |

*Test terminated - not failed.
+Test still in progress.

Figure 8:
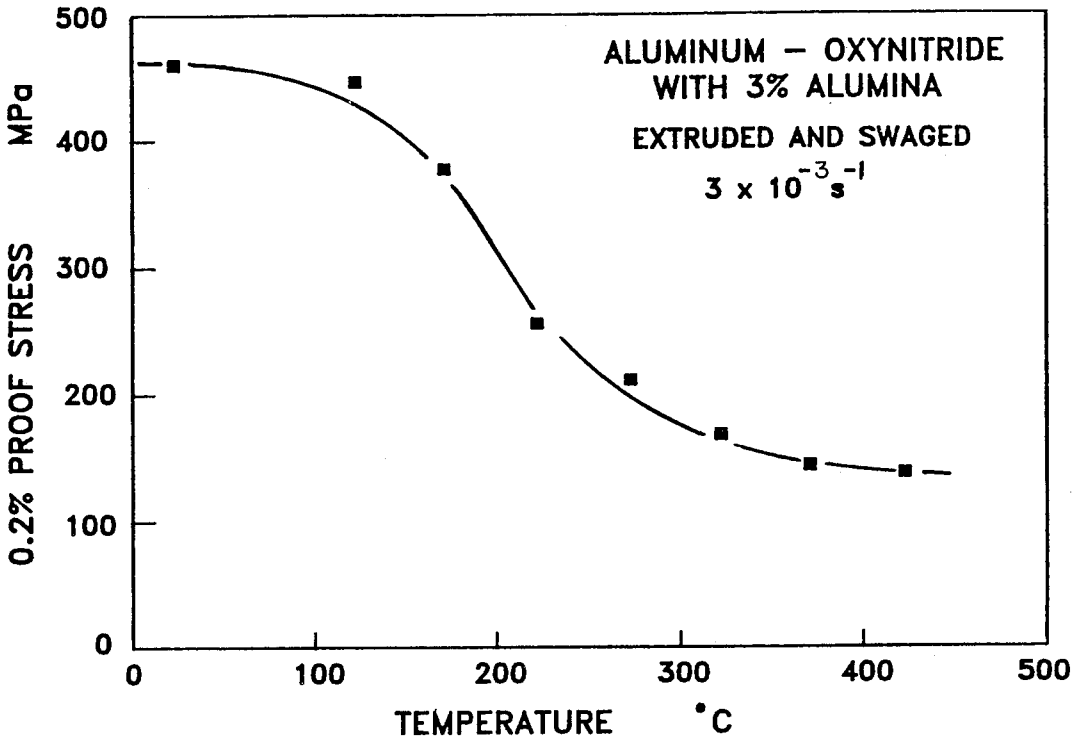
FIG. 8 is a graphical representation of the 0.2% proof stress versus temperature data, obtained in compression, on samples of the aluminum—aluminum oxy-nitride with 3% alumina consolidated by extrusion and described in Example 1 hereof.

Additional 585 g batches of metal/oxide powder mixtures were prepared by the procedures described above containing 3% and 7% by weight of alumina. The alloyed powder batches were placed in 75 mm diameter aluminum extrusion cans and evacuated in the manner described above for the hot isostatic pressing cans. These extrusion billets were subsequently extruded at 450° C. at ram speed of 5 mm/s into round bars 18 mm in diameter. Samples of material cut from these bars were prepared as 7.2×5.1 mm diameter compression samples and tested in the manner described above. These data are given in Table IX and the 0.2% proof stress as a function of temperature is shown in FIG. 8.

For each extruded rod, a sample was cut perpendicular to the extrusion axis and was analyzed for texture by use of a Rigaku DMAX-II-4 diffractometer combined with an automatic pole figure device. Data were collected for the <200>reflection. The Decker method was employed in transmission and the Schultz method in reflection so that the entire pole figure could be obtained (R. D. Cullity, "Elements of X-ray Diffraction", Addison-Wesley, Reading, Mass., 1967, pp. 285–295). As shown in FIG. 12, the pole figure obtained on the aluminum/aluminum oxynitride alloy containing 3% alumina, the sample is virtually free of any texture.

Additionally, samples of the alloys were cut into thin plates and prepared as thin foils for examination by transmission electron microscopy. Examples of the transmission electron micrographs obtained from these samples are shown in FIGS. 4*a* and 4*c* hereof.

TABLE IX

COMPRESSION TEST DATA FOR ALUMINUM/OXYNITRIDE-3% ALUMINA AS EXTRUDED AND SWAGED

| Temperature °C. | Strain Rate/ s | Yield Stress MPa |
|---|---|---|
| 25 | $3 \times 10^{-3}$ | 456 |
| 125 | $3 \times 10^{-3}$ | 443 |
| 175 | $3 \times 10^{-3}$ | 373 |
| 225 | $3 \times 10^{-3}$ | 253 |

TABLE IX-continued

COMPRESSION TEST DATA FOR ALUMINUM/OXYNITRIDE-3% ALUMINA AS EXTRUDED AND SWAGED

| Temperature °C. | Strain Rate/ s | Yield Stress MPa |
|---|---|---|
| 275 | $3 \times 10^{-3}$ | 207 |
| 325 | $3 \times 10^{-3}$ | 163 |
| 375 | $3 \times 10^{-3}$ | 140 |
| 425 | $3 \times 10^{-3}$ | 135 |

Results

Figure 4:
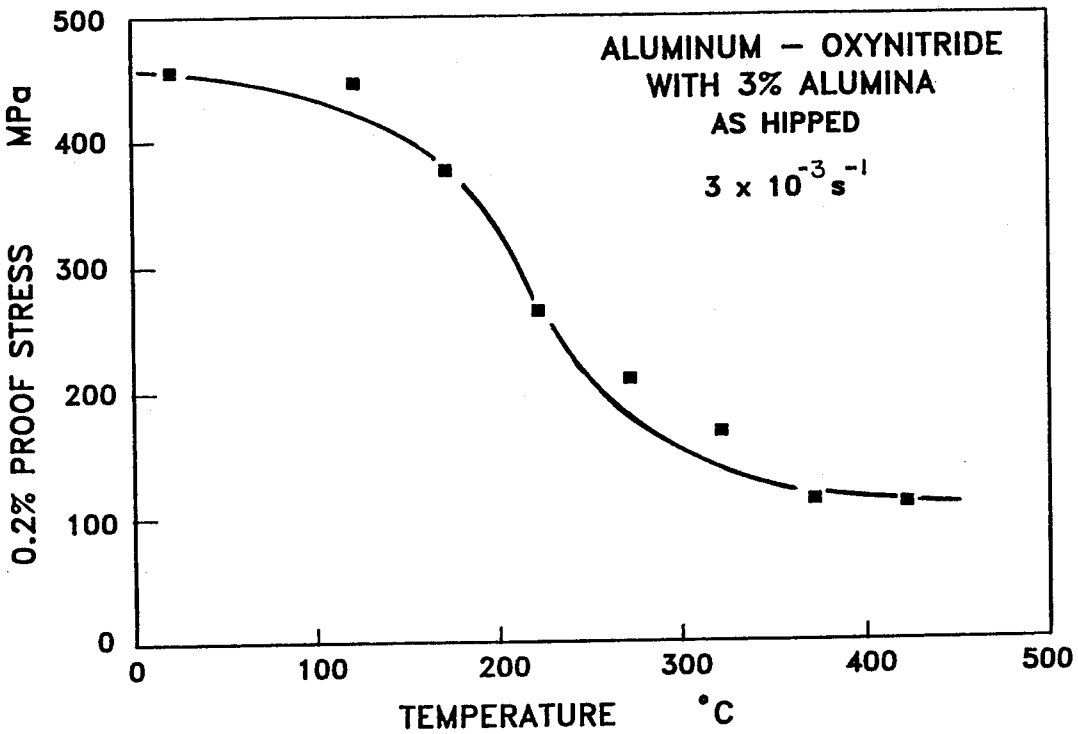
FIG. 4 is a graphical representation of the 0.2% proof stress versus temperature data, obtained in compression on samples of the hot isostatically consolidated aluminum—aluminum oxy-nitride with 3% alumina materials described in Example 1 hereof.
Figure 5:
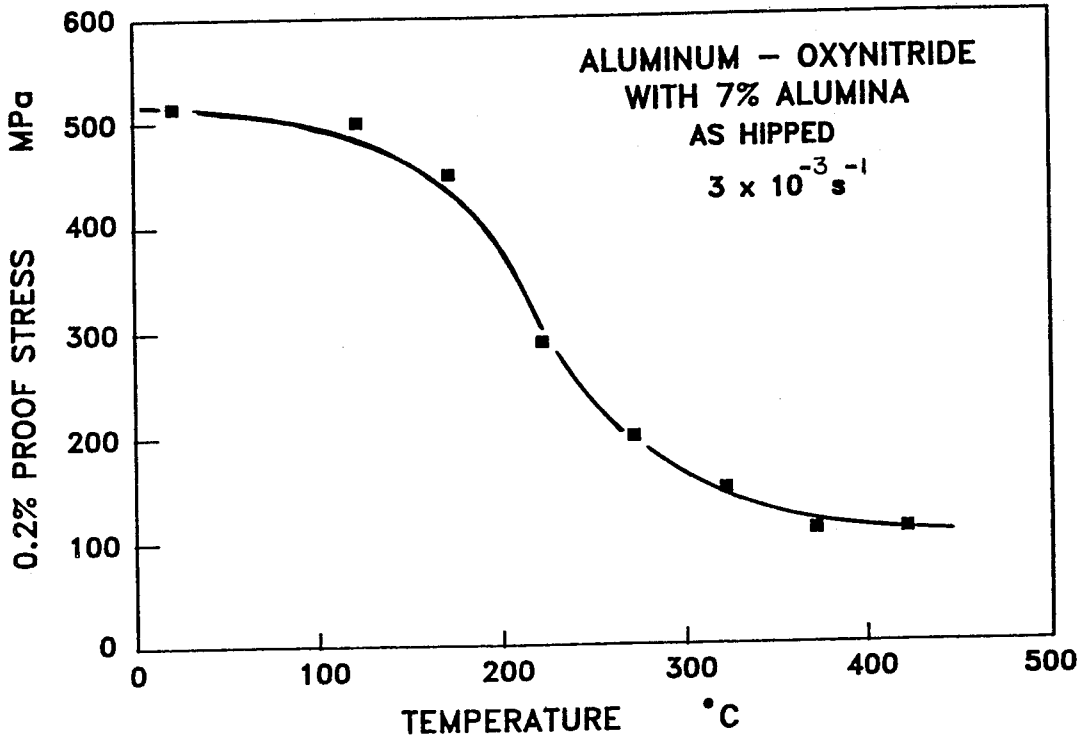
FIG. 5 is a graphical representation of the 0.2% proof stress versus temperature data, obtained in compression on samples of the hot isostatically consolidated aluminum—aluminum oxy-nitride with 7% alumina materials described in Example 1 hereof.
Figure 6:
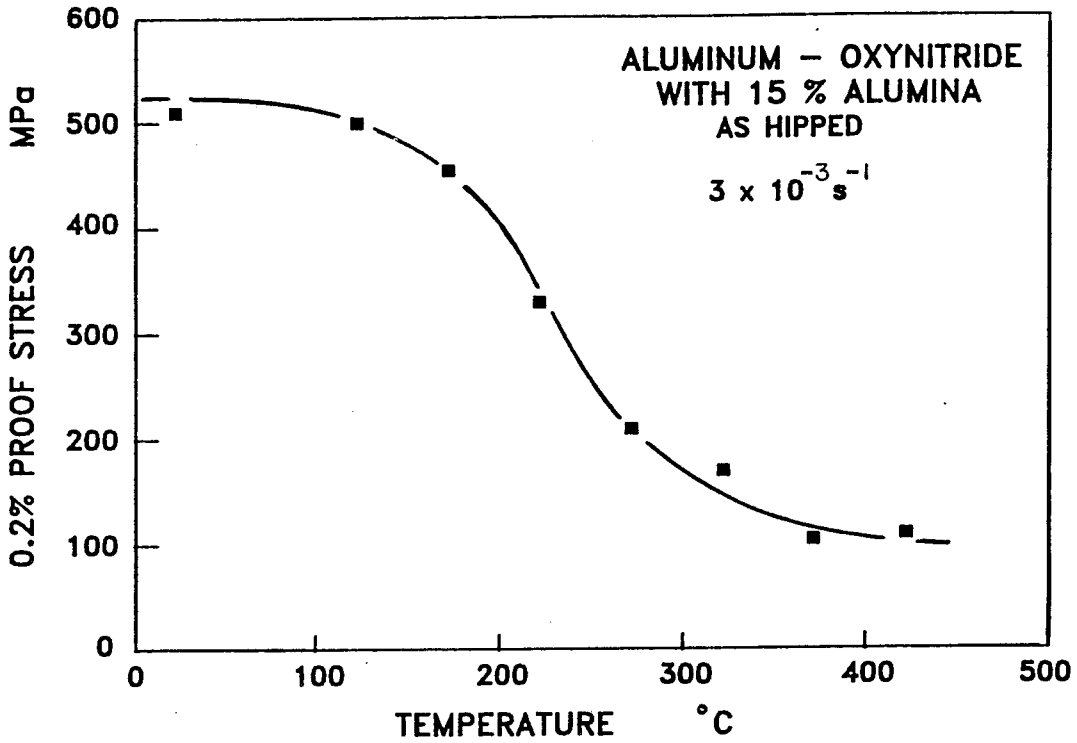
FIG. 6 is a graphical representation of the 0.2% proof stress versus temperature data, obtained in compression on samples of the hot isostatically consolidated aluminum—aluminum oxy-nitride with 15% alumina materials described in Example 1 hereof.
Figure 7:
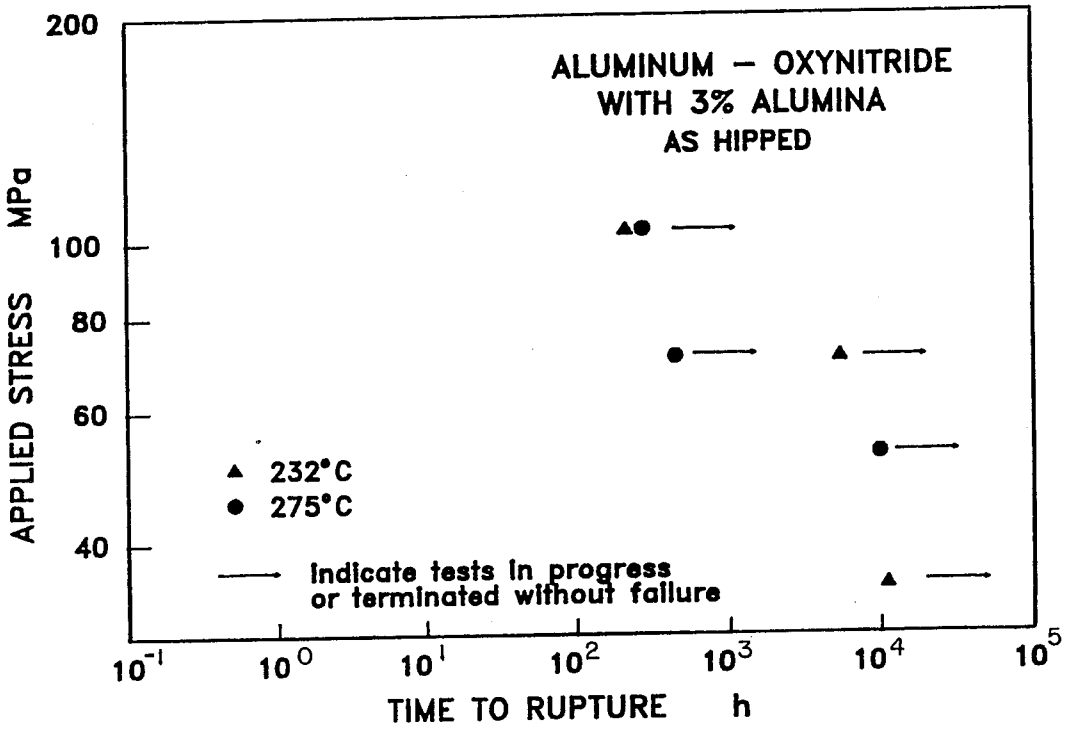
FIG. 7 is a graphical representation of the creep rupture data obtained for the aluminum—aluminum oxy-nitride with 3% alumina material, consolidated by hot isostatic pressing and swaged, as described in Example 1 hereof.

Comparison of the data in Tables V to VII and represented in FIGS. 4 to 6 show that the alloys prepared in accordance with the present invention exhibit superior strength properties to conventionally mechanically alloyed aluminum material, such as those set forth in Comparative Example B above. The present alloys start to lose the strength exhibited at room temperature only above 250° C. compared with about 180° C. for the Novamet alloys. Thus preparation of alloys by the present invention extends the temperature resistance of aluminum alloys by about 50° C. Furthermore, at high temperatures, above about 400° C., the strength level is approximately three times higher than that of the comparative material.

Figure 9A:
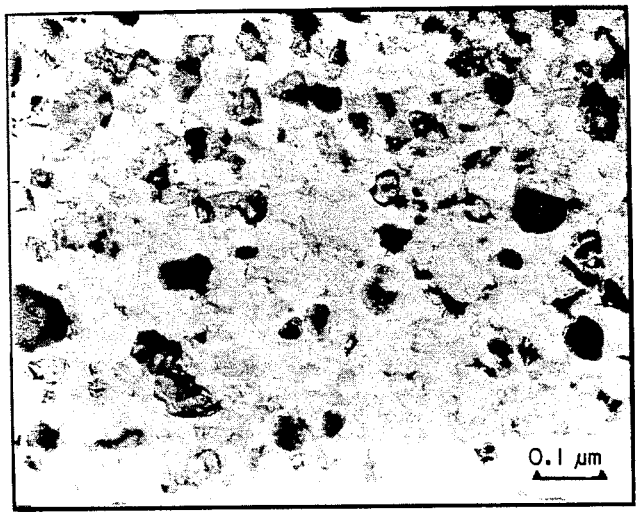
Figure 9B:
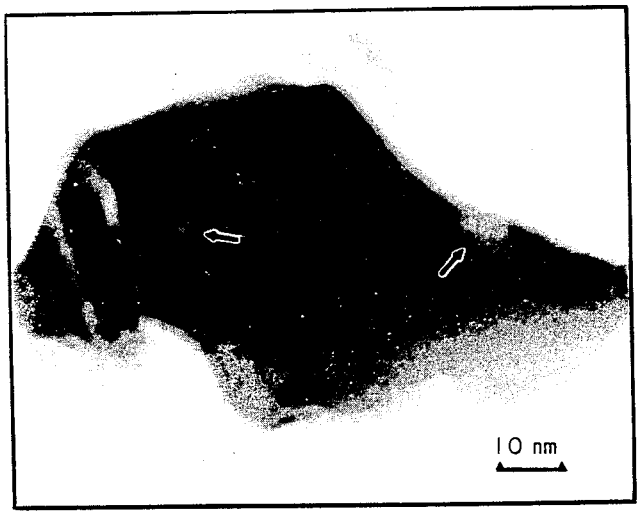

The observed strengthening at high temperatures can be attributed to the presence of the ultra-fine dispersoids of aluminum oxy-nitride that are introduced as a result of insitu surface reactions during the cryomilling process. These fine dispersoids are displayed in FIG. 9*b* as the light contrast areas as indicated by arrows. These dispersoids strongly pin the grain boundaries and control recrystallization and grain growth at high temperatures, resulting in an L extremely uniform grain size, typically 0.05 μm in diameter. This compares with the conventionally mechanically alloyed material, of Comparative Example B, where no evidence for these fine dispersoids was found and the grain size is non-uniform and the mean grain diameter is typically 0.5 μm.

The fact that the high temperature strength, in particular is imparted by the ultra-fine aluminum oxy-nitride particles, is the observation that the 0.2% proof stress versus temperature curves, for alloys containing 3%, 7% and 15% of the added alumina, overlap almost exactly. In other words, the proof stress of the alloys, prepared by the present invention, exhibit the same strength at all temperature independent of the amount of alumina that is initially added to the mill. This effect is explained by realizing that the strength level provided by the alumina particles that are formed by repeated fracture of the added alumina is small since the particles are relatively large (0.02 μm) and so is their spacing (0.1 μm). By contrast, the aluminum oxy-nitride particles, formed insitu during cryomilling, are much finer (≈3 nm in diameter) and are spaced at intervals of ≈0.02 μm, thus producing a much higher strength level. Accordingly, since the majority of the strength is due to the ultra-fine oxy-nitrides, and their volume fraction is independent of the added alumina amount, the strength of the alloys must also be independent of the added alumina content.

Furthermore, by extruding the instant compositions through the die described in Example 1, above, a texture free product is obtained. This results by virtue of the ultra-fine grain size of the powders generated by the cryogenic milling process disclosed herein.

What is claimed is:

1. A method for extruding fine grain aluminum mechanically alloyed powder material into rods such that the resulting extruded product is substantially free of texture, which method comprises extruding a billet of the powder material having a mean grain size less than about 5 microns through a die having an internal contour which conforms substantially to the formula:

$$\frac{1}{R^2} = \frac{1}{R_o^2} + Kx$$

where R is the radius of the die contour at any given point x along the major axis of the die orifice from its entry plane, $R_o$ is the radius of the billet, and K is an arbitrary constant.

2. The method of claim 1 wherein the alloyed powder also contains aluminum oxy-nitride particles.

3. The method of claim 2 wherein up to 5 vol. % aluminum oxy-nitrides are present.

4. The method of claim 3 wherein about 0.01 to 0.5 vol. % aluminum oxy-nitrides are present.

5. The method of claim 2 wherein a refractory material, as well as the oxy-nitrides, is also present such that the total volume % of oxynitrides and other refractory materials is up to about 25%.

6. The method of claim 5 wherein the total volume of oxy-nitrides plus other refractory material is from about 0.5 to 10%.

7. The method of claim 5 wherein the other refractory material is selected from the group consisting of oxides, carbides, nitrides, carbonitrides, and mixtures thereof.

8. The method of claim 7 wherein the other refractory material is one or more oxides.

9. The method of claim 8 wherein the oxide is alumina.

10. The method of claim 5 wherein one or more metals, other than aluminum, is present such that the aluminum content is at least 50 wt. %, based on the total weight of the powder material.

11. The method of claim 10 wherein the powder material is comprised of at least 80 wt. % aluminum.

12. A method for extruding fine grain aluminum mechanically alloyed powdered material into tubulars such that the resulting extruded product is substantially free of texture, which method comprises extruding a billet of the powder material having a mean grain size less than about 5 microns through a die having an internal contour which conforms substantially to the formula:

$$\frac{1}{R^2} = \frac{(1 + Kx)}{(R_o^2 + R_m^2 Kx)}$$

where

R is the radius of the die contour at any given point x along the major axis of the die orifice from its entry plane;

Ro is the outer radius of the billet;

Rm is the radius of the mandrel; and

K is an arbitrary constant.

* * * * *